US010577148B2

(12) United States Patent
Gogola et al.

(10) Patent No.: US 10,577,148 B2
(45) Date of Patent: Mar. 3, 2020

(54) TABS AND RELATED METHODS

(71) Applicant: Ardagh Metal Beverage USA Inc., Chicago, IL (US)

(72) Inventors: Michael R. Gogola, Itasca, IL (US); Randall G. Forrest, Park Ridge, IL (US)

(73) Assignee: Ardagh Metal Beverage USA Inc., Chicago, IL (US)

( * ) Notice: Subject to any disclaimer, the term of this patent is extended or adjusted under 35 U.S.C. 154(b) by 124 days.

(21) Appl. No.: 15/782,656

(22) Filed: Oct. 12, 2017

(65) Prior Publication Data

US 2019/0112096 A1 Apr. 18, 2019

(51) Int. Cl.

| | |
|---|---|
| ***B65D 17/28*** | (2006.01) |
| ***B21D 51/38*** | (2006.01) |
| ***B65D 17/34*** | (2006.01) |

(52) U.S. Cl.

CPC ..... *B65D 17/4011* (2018.01); *B21D 51/383* (2013.01); *B65D 17/34* (2018.01); *B65D 17/4012* (2018.01); *B65D 2517/0014* (2013.01); *B65D 2517/0059* (2013.01)

(58) Field of Classification Search

CPC ..... B65D 17/4011; B65D 17/4012; B65D 2517/0092; B65D 17/32; B65D 2517/0071; B65D 2517/0073; B21D 51/383

See application file for complete search history.

(56) References Cited

U.S. PATENT DOCUMENTS

| | | | | |
|---|---|---|---|---|
| 3,527,378 | A | 9/1970 | Scharf et al. | |
| 3,715,051 | A * | 2/1973 | Hanke | B65D 17/4011 220/273 |
| 3,724,709 | A | 4/1973 | Westphal | |
| 3,780,902 | A * | 12/1973 | Holc | B65D 17/163 220/270 |
| 3,795,342 | A | 3/1974 | Ashton | |

(Continued)

FOREIGN PATENT DOCUMENTS

| | | |
|---|---|---|
| EP | 1603802 | 8/2011 |
| EP | 2861502 | 8/2016 |

(Continued)

OTHER PUBLICATIONS

Zazzle, "Tin Can Lid Classic Round Sticker," dated Mar. 8, 2012, retrieved from [https://www.zazzle.com/tin_can_lid_classic_round_sticker-217543141707448287, 10 pages.

(Continued)

*Primary Examiner* — Shawn M Braden

(74) *Attorney, Agent, or Firm* — Hanley, Flight & Zimmerman, LLC

(57) ABSTRACT

Tabs having cleats and related methods are disclosed. An example tab includes a lift end and a nose opposite the lift end, where the nose is to at least partially extend over a pour panel of the can end. A central webbing is interposed between the lift end and the nose. The central webbing defines a hinge line about which the tab is to pivot away from a center panel of the can end when the tab is coupled to the can end. A first cleat is formed on the nose. The first cleat is offset relative to a first side of the center axis of the tab such that a longitudinal axis of the first cleat intersects the center axis at a first angle.

23 Claims, 13 Drawing Sheets

(56) References Cited

U.S. PATENT DOCUMENTS

| | | | | |
|---|---|---|---|---|
| 3,836,038 | A | 9/1974 | Cudzik | |
| 3,863,801 | A * | 2/1975 | Pillnik | B65D 17/163 220/267 |
| 3,941,277 | A * | 3/1976 | McKinney | B65D 17/4011 220/273 |
| 3,967,753 | A | 7/1976 | Cudzik | |
| 3,989,161 | A | 11/1976 | Pillnik | |
| 4,042,144 | A * | 8/1977 | Henning | B65D 17/4011 220/273 |
| 4,130,074 | A | 12/1978 | Cudzik | |
| 4,162,743 | A | 7/1979 | Cudzik | |
| 4,416,389 | A | 11/1983 | Wilkinson et al. | |
| 4,576,305 | A | 3/1986 | Saunders | |
| 4,930,658 | A | 6/1990 | McEldowney | |
| 4,994,009 | A | 2/1991 | McEldowney | |
| 5,129,541 | A * | 7/1992 | Voigt | B65D 17/4012 220/269 |
| D365,274 | S | 12/1995 | Cook | |
| 5,668,094 | A | 11/1997 | Saunders | |
| D387,666 | S | 12/1997 | Wise | |
| D387,987 | S | 12/1997 | Neiner | |
| D397,296 | S | 8/1998 | McEldowney et al. | |
| D402,887 | S | 12/1998 | Hurst | |
| D415,026 | S | 10/1999 | Turner et al. | |
| 5,967,726 | A | 10/1999 | Turner et al. | |
| D419,873 | S | 2/2000 | Piccione | |
| 6,024,239 | A | 2/2000 | Turner et al. | |
| D424,438 | S | 5/2000 | Turner et al. | |
| D476,889 | S | 7/2003 | Fields | |
| 6,902,078 | B2 | 6/2005 | Fiorentini | |
| D569,246 | S | 5/2008 | Thanisch et al. | |
| D579,771 | S | 11/2008 | Cherian | |
| D600,116 | S | 9/2009 | Cherian | |
| 7,614,520 | B2 * | 11/2009 | McEldowney | B21D 51/383 220/269 |
| 7,677,404 | B2 * | 3/2010 | McEldowney | B65D 17/4012 220/269 |
| D617,188 | S | 6/2010 | Sturk | |
| D620,796 | S | 8/2010 | McEldowney et al. | |
| D624,413 | S | 9/2010 | Selina et al. | |
| D637,489 | S | 5/2011 | Petlak et al. | |
| 7,975,520 | B2 | 7/2011 | McEldowney et al. | |
| D645,342 | S | 9/2011 | Allers et al. | |
| D645,343 | S | 9/2011 | Allers et al. | |
| D653,944 | S | 2/2012 | Seki et al. | |
| 8,109,405 | B2 | 2/2012 | Butcher et al. | |
| 8,161,787 | B2 | 4/2012 | McEldowney et al. | |
| 8,646,643 | B2 | 2/2014 | Forrest et al. | |
| D704,555 | S | 5/2014 | Hernandez | |
| D711,225 | S | 8/2014 | Lund | |
| 8,904,843 | B2 | 12/2014 | Butcher et al. | |
| 9,181,007 | B2 | 11/2015 | Forrest et al. | |
| 9,199,763 | B2 * | 12/2015 | Dunwoody | B65D 17/4012 |
| 2005/0006388 | A1 | 1/2005 | Turner et al. | |
| 2008/0110888 | A1 | 5/2008 | Turner et al. | |
| 2008/0257900 | A1 | 10/2008 | Turner et al. | |
| 2010/0116374 | A1 | 5/2010 | Wilson et al. | |
| 2011/0297679 | A1 | 12/2011 | Gogla et al. | |
| 2011/0303672 | A1 | 12/2011 | Fields et al. | |
| 2013/0334226 | A1 * | 12/2013 | Forrest | B65D 17/4012 220/273 |
| 2014/0110408 | A1 | 4/2014 | Mitchell et al. | |
| 2014/0263320 | A1 * | 9/2014 | Forrest | B65D 51/1677 220/231 |
| 2015/0129595 | A1 * | 5/2015 | Kittler | B65D 41/005 220/269 |
| 2015/0367984 | A1 * | 12/2015 | Forrest | B65D 17/4012 220/269 |
| 2016/0039565 | A1 | 2/2016 | Gatewood | |
| 2017/0029165 | A1 | 2/2017 | Gogola et al. | |
| 2017/0043903 | A1 | 2/2017 | Gogola et al. | |

FOREIGN PATENT DOCUMENTS

| | | |
|---|---|---|
| WO | 9901243 | 1/1999 |
| WO | 2013188556 | 12/2013 |

OTHER PUBLICATIONS

Crowell, "SweetWater to upgrade its can tabs," Craft Brewing Business, retrieved from [https://www.craftbrewingbusiness.com/packaging-distribution/sweetwater-upgrade-can-tabs], dated Oct. 27, 2014, 10 pages.

United States Patent and Trademark Office, "Requirement for Restriction," issued in connection with U.S. Appl. No. 29/622,681, dated Jun. 12, 2019, 13 pages.

United States Patent and Trademark Office, "Requirement for Restriction," issued in connection with U.S. Appl. No. 29/622,680, dated May 30, 2019, 9 pages.

United States Patent and Trademark Office, "Non-Final Office Action," issued in connection with U.S. Appl. No. 29/622,680, dated Dec. 20, 2019, 5 pages United States Patent and Trademark Office, "Ex parte Quayle Action," issued in connection with U.S. Appl. No. 29/622,681, dated Dec. 20, 2019, 5 pages.

* cited by examiner

TABS AND RELATED METHODS

FIELD OF THE DISCLOSURE

This disclosure relates generally to can ends and, more particularly, to improved tabs and related methods.

BACKGROUND

Large volumes of metal are consumed each year to manufacture billions of beverage containers and cans. To reduce manufacturing or material costs, manufactures are constantly striving to reduce amounts of materials (e.g., a gauge of metal) used to manufacture tabs, can ends and/or can bodies. However, reducing volume of materials (e.g., reducing a gauge of metal) may affect (e.g., reduce) strength characteristic(s) of the tabs, can ends and/or can bodies.

SUMMARY

An example tab includes a lift end and a nose opposite the lift end, where the nose is to at least partially extend over a pour panel of the can end. A central webbing is interposed between the lift end and the nose. The central webbing defines a hinge line about which the tab is to pivot away from a center panel of the can end when the tab is coupled to the can end. A first cleat is formed on the nose. The first cleat is offset relative to a first side of the center axis of the tab such that a longitudinal axis of the first cleat intersects the center axis at a first angle.

An example tab includes a center panel having a pour panel defined by a score. A tab is to pivot relative to the center panel to apply an opening force to rupture the score and displace the pour panel relative to the center panel to provide a pour opening. The tab includes a lift end and a nose spaced from the lift end. A first cleat is formed on the nose. The first cleat is offset relative to a center axis of the tab. The first cleat to concentrate the opening force in a first direction that is non-parallel relative to the center axis when the tab is lifted relative to the center panel of the can end between an initial position and a first angular position. A second cleat is formed on the nose. The second cleat is offset relative to the center axis of the tab. The second cleat is to concentrate the opening force in a second direction that is non-parallel relative to the center axis when the tab is lifted relative to the center panel between the first angular position and a second angular position greater than the first angular position, the first direction being different than the second direction.

A example method of forming a tab for a can end includes positioning a nose of the tab over a die having an angled support surface; striking an upper surface of the nose with a punch to form one or more cleats on the nose of the tab; and removing the punch from the nose after formation of the cleats. In some examples, the method includes striking the upper surface of the nose includes causing the nose to bend in a direction below normal and against the angled support surface.

An example can end includes a center panel having a tear panel defined by a score, and a tab pivotally coupled to the center panel via a rivet. The tab is to pivot relative to the center panel to apply an opening force to rupture the score and displace the tear panel relative to the center panel to provide a pour opening. The tab includes a lift end and a nose spaced from the lift end and a first cleat formed on the nose. The first cleat to concentrate the opening force in a first direction when the tab is lifted relative to the center panel of the can end between an initial position and a first angular position, where formation of the first cleat provides the nose with an arcuate profile relative to normal to maintain the nose at a predetermined distance from the center panel when the center panel has at least one of a first structural profile or a second structural profile different than the first structure profile.

Figure 1A:
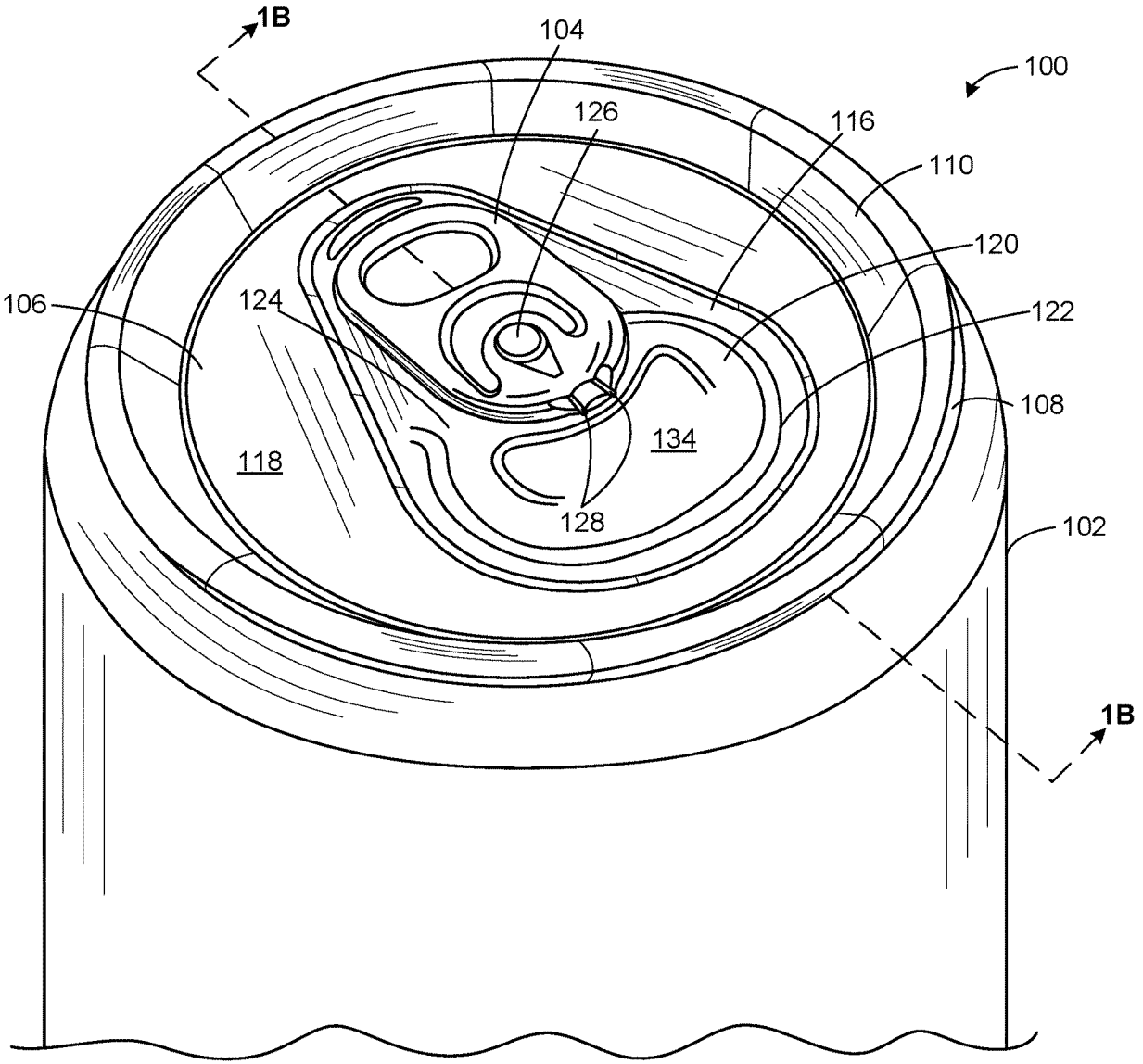
FIG. 1A is a perspective view of an example container having a can end that may be implemented with an example tab constructed in accordance with the teachings of this disclosure.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, indicates that the referenced part is either in contact with the other part, or that the referenced part is above the other part with one or more intermediate part(s) located therebetween. Stating that any part is in contact with another part means that there is no intermediate part between the two parts. Stating that a part is coupled or connected to another part indicates that the parts are joined directly or through one or more intervening parts. Thus, physical contact is not required for two parts to be coupled or connected.

DETAILED DESCRIPTION

Beverage containers employ easy-open ends. Easy-open ends typically include a tear or opening panel and an attached leverage tab for pushing the pour panel into the container to open the end and access contents (e.g., liquid) stored inside the container. To open a can end, the leverage tab displaces the pour panel of the can end. Specifically, the tab remains attached to the can end after the tab is used to open the pour panel. Such known can ends are commonly referred to as "ecology" or "stay-on-tab" (SOT) ends.

The pour panel is formed in the can end via a score. When the tab is lifted and forced against the pour panel, the tab applies a force (e.g., an opening force) against the pour panel to cause the score to rupture or sever along a length of the score. The tab displaces the pour panel at an angular orientation relative to the remaining container end to create a pour opening through which the contents may be dispensed from the container.

To improve pourability and/or drinkability through the pour opening, some known beverage container ends employ a large-opening end (LOE). For example, large-opening ends provide a larger area and/or opening for easier drinking and pouring. In a 202 LOE, the pour opening is generally larger than 0.5 square inches in area (e.g., whereas pour openings of standard-opening ends are generally less than 0.5 (e.g., approximately 0.4) square inches in area). Thus, rupturing the score of a LOE may require a greater amount of force to be imparted to the pour panel via the leverage tab than, for example, a conventional size pour panel (e.g., a pour panel providing a pour opening that is less than 0.5 square inches in area). For example, the relative size of a pour panel also affects the rupture performance of a pour panel because a panel of larger area tends to bend more and, thus, distributes the opening force applied by the tab more than a smaller score panel of the same metal gauge.

Moreover, pour panels providing larger pour openings may require rotation of the tab about a rivet (e.g., a vertical axis of the rivet) to apply tab nose forces in a plurality of locations on the pour panel to bend the pour panel into the container as the pour panel separates along the score. Such larger forces may not be achievable with conventional tabs and/or may make it more difficult to open the pour panel. Thus, such larger forces may necessitate a longer or larger size tab. However, through the use of ecology of can ends, manufacturers have sought to save the expense of the metal by down gauging metal of the can ends and/or tabs. Therefore, increasing the size of the tab (e.g., thickness and/or length of the tab) to increase leverage force may increase material costs.

Alternatively, a smaller score residual may be used to reduce an amount of opening force required to open a large-opening end. The score residual is an amount of material thickness of the score between an outer surface of the pour panel and an inner surface of the pour panel. However, smaller score residuals may limit an application of the can end. For example, beverage containers store pressurized contents (e.g., carbonated liquids) and/or contents that require heat treatment or pasteurization. Decreasing a score residual (e.g., a score residual that is too thin) makes the score residual prone to accidental opening or score failure more likely to occur. For example, a smaller score residual may cause the score of the pour panel to rupture prematurely (e.g., during the pasteurization process, shipping, etc.). Thus, the score of the pour panel should have sufficient score residual to withstand such pressure, temperature changes, heat treatments, etc.

In turn, however, a larger score residual requires that the tab have a sufficient thickness of metal to provide sufficient opening force to rupture the score of the pour panel. Thus, for example, a larger score residual may require increasing material gauge, thereby increasing material costs. Thus, a score line depth that is too deep can subject the can ends to rupture during production, packaging and/or shipping operations. On the other hand, if the score depth is too shallow, excessive force may be required to rupture the score. In such a situation, even if the user is physically able to apply sufficient force to rupture the score line, the tab may deform (e.g., the tab may buckle) in a manner to prevent complete rupture of the full length of the score. For example, a larger score residual increases an amount of pop force and/or opening force required by the tab. An increase in pop force and/or opening force typically requires increasing a strength of the tab by increasing dimensional characteristics (e.g., thickness, length, etc.) of the tab, which increases material costs.

Additionally, can ends are made in a variety of sizes from 202 to 211 (using conventional can makers' terminology). There is continual pressure to reduce the size of can ends. For example, 206 size can ends were conventionally used for all beverage cans and these size ends are still used on many of the beer cans in Europe. However, 202 size can ends for soft drinks are now the industry standard in both the United States and Europe and there is industry pressure to reduce all 206 size can ends to 202 size can ends. Thus, can ends are being produced with successively smaller diameter ends to provide cost savings through light-weighting. Thus, increasing a size (e.g., a length) of the tab may not be an option because it may require increasing a size (e.g., a diameter) of the container end, thereby increasing manufacturing costs and opposing a market trend of producing smaller diameter can ends.

Example tabs disclosed herein can withstand or provide larger opening forces and/or pressures without increasing material costs compared to conventional tabs. Additionally, example tabs may be employed with large-opening ends (LOE). Specifically, example tabs disclosed herein may be employed with pour panels of LOEs having a greater range residual scores than residual scores of conventional LOEs. In particular, example container ends disclosed herein employ tabs having improved strength characteristics or properties. To improve strength characteristics, example tabs disclosed herein include one or more cleats to direct or target an opening force and/or pressure to a pour panel of the container end. To this end, a dimensional characteristic (e.g., a thickness and/or length) of (e.g., a nose) of the tab does not require additional thickness or added material compared to a conventional tab that does not employ the cleats. In other words, example tabs disclosed herein may be formed to have a length to accommodate or fit smaller can end sizes (e.g. 202 size can ends) having larger opening ends (LOE) and provide force characteristics to open pour panels configured as LOEs. Example tabs disclosed herein may be used with 209 size can ends (6.509 cm); 207.5 size can ends (6.271 cm); 206 size can ends (6.033 cm), 204 size can ends (5.715 cm), 202 size can ends (5.398 cm) and/or any other size can ends.

Figure 1B:
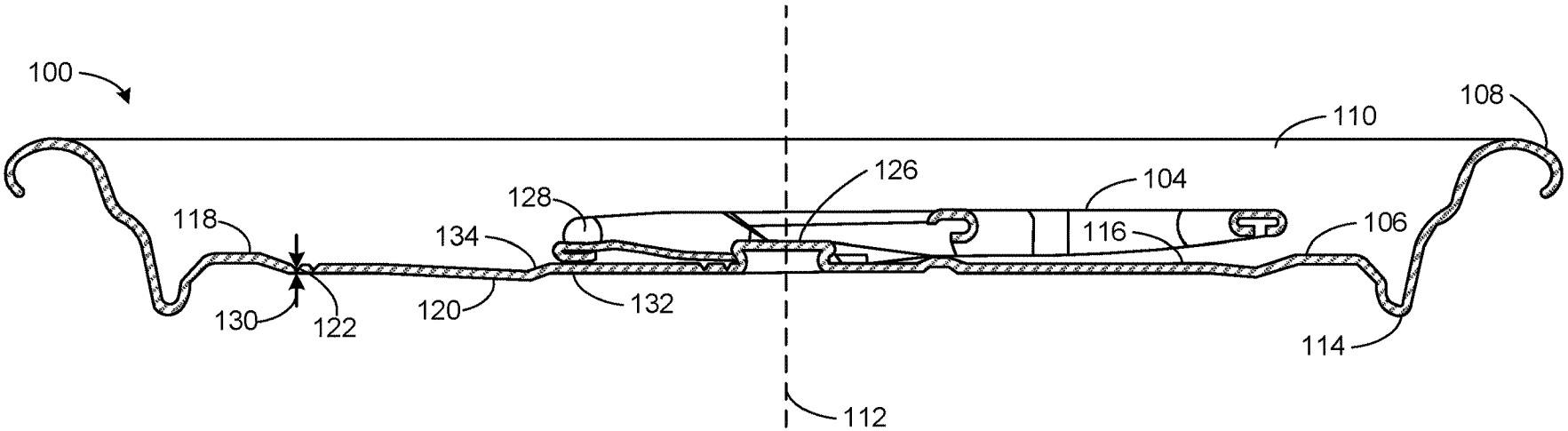
FIG. 1B is a cross-sectional view of the example can of FIG. 1A taken along line 1B-1B of FIG. 1A.

FIG. 1A is an example can end 100 (e.g., a beverage can end) constructed in accordance with the teachings of this disclosure that may implement a container 102. FIG. 1B is a cross-sectional view of the example can end 100 of FIG. 1A taken along line 1B-1B of FIG. 1A. Referring to FIGS. 1A and 1B, the can end 100 of the illustrated example includes a tab 104 constructed in accordance with the teachings of this disclosure.

The can end 100 of the illustrated example has a center panel 106 separated from a seaming curl 108 by a circumferential wall 110. The seaming curl 108 of the illustrated example defines an outer perimeter of the can end 100 (e.g., a 202 size can end). The seaming curl 108 of the illustrated example is generally centered about a longitudinal or vertical axis 112 (FIG. 1B). The circumferential wall 110 of the illustrated example extends (e.g., downward) from the seaming curl 108 to a strengthening member 114 (e.g., a bend) that is jointed to (e.g., integral with) the center panel 106. The can end 100 of the illustrated example is joined to the container 102 via the seaming curl 108.

The center panel 106 of the illustrated example includes a deboss panel 116. The deboss panel 116 of the illustrated example is recessed relative to a surface 118 of the center panel 106. To provide a pour opening, the can end 100 of the illustrated example includes a pour panel 120. The deboss panel 116 of the illustrated example circumscribes the pour panel 120 and the tab 104. The deboss panel 116 of the illustrated example increases a relative stiffness of the pour panel 120 to improve openability of the pour panel 120. In some examples, a can end implemented with the example tab 104 may not include the deboss panel 116.

The pour panel 120 of the illustrated example is defined by a frangible score 122 and a non-frangible hinge 124. The pour panel 120 of the illustrated example may be severed from the center panel 106 via the frangible score 122 and displaced at an angular orientation relative to the center panel 106 while the pour panel 120 remains connected to the center panel 106 via the hinge 124. Displacing the pour panel 120 relative to the center panel 106 provides a pour opening of the can end 100.

To open or displace the pour panel 120 relative to the center panel 106, the can end 100 of the illustrated example includes the tab 104. The tab 104 is positioned in the deboss panel 116. The tab 104 of the illustrated example is pivotally and/or rotatably coupled to the center panel 106 via a rivet 126 (e.g., rotates about a longitudinal axis of the rivet). The tab 104 of the illustrated example at least partially extends over the pour panel 120.

To enhance openability of the pour panel 120, the tab 104 of the illustrated example includes one or more cleats 128. As discussed in greater detail below, the cleats 128 of the illustrated example increase a pushing pressure and/or force to the pour panel 120, thereby allowing score depth latitude and/or allowing manufacturing of the tab 104 using a thinner material (e.g., a lower gauge aluminum). For example, the cleats 128 increase a contact area on the pour panel to increase a pressure on the teal panel. Additionally or alternatively, the cleats 128 increase strength of the tab (e.g., provide added stiffness) that enables a user to apply a greater force to the pour panel (e.g., allows a user to pull harder) without causing the tab 104 to deform and/or buckle. In some examples, the cleats 128 of the illustrated example increase the overall longitudinal length of the tab 104, thereby increasing a leverage force of the tab 104 against the pour panel when the tab 104 is lifted.

In this manner, a score residual 130 (FIG. 1B) may be greater than score residuals of conventional can ends. The score residual 130 is a material thickness of the frangible score 122 between an inner surface 132 (e.g., a product side) of the pour panel 120 and an outer surface 134 (e.g., a public side) of the pour panel 120. For example, the score residual 130 of the illustrated example may be approximately between 0.0032 and 0.0038 inches and the deboss panel 116 may be approximately 0.016 inches. Additionally or alternatively, the cleats 128 of the illustrated example reduce the likelihood of the tab 104 slipping or sliding (e.g., backwards) relative to pour panel 120 in a direction toward the rivet 126, thereby reducing tuck under opening failures.

Figure 2A:
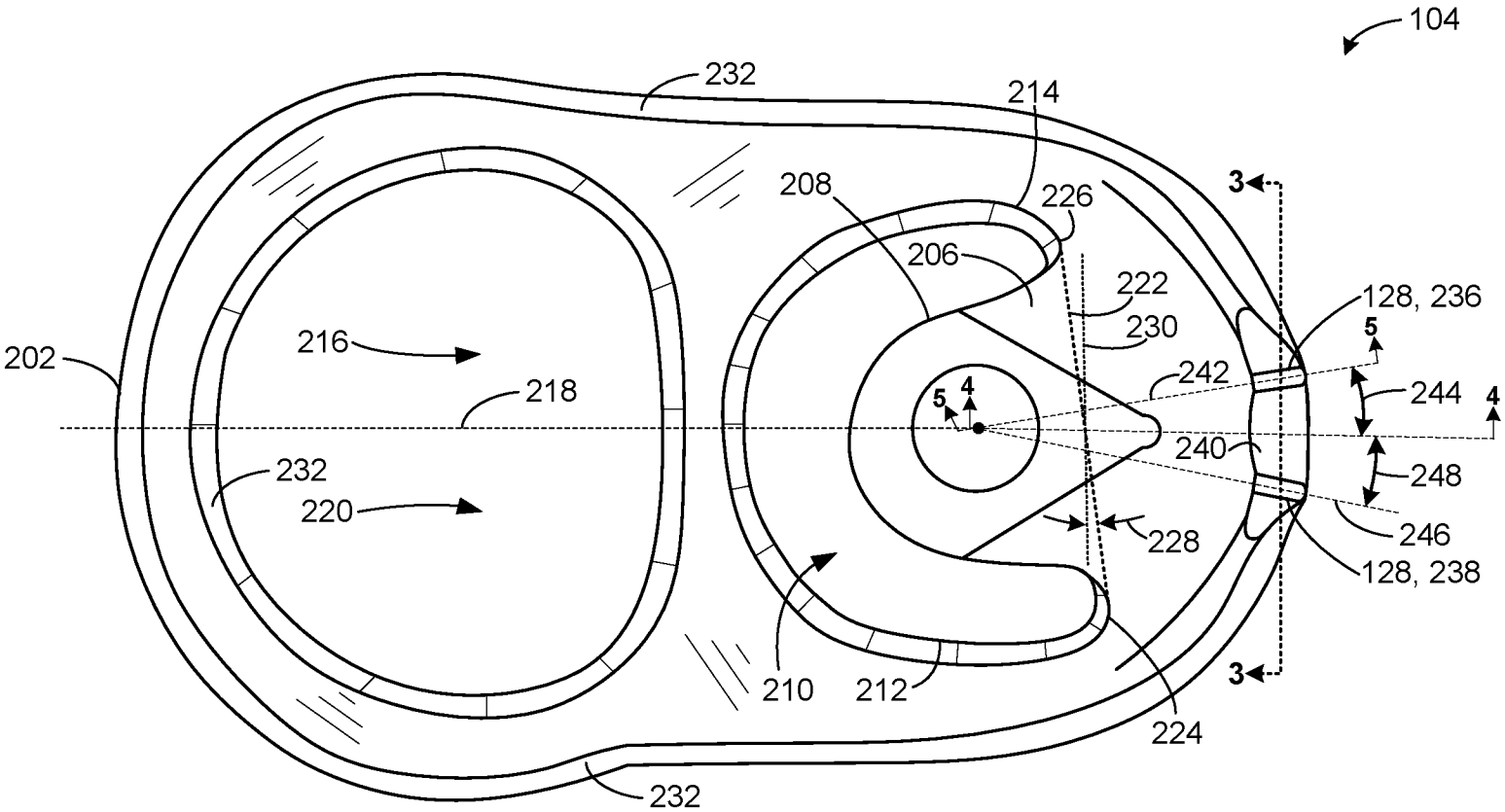
FIG. 2A is a top view of the example tab of FIGS. 1A and 1B.
Figure 2B:
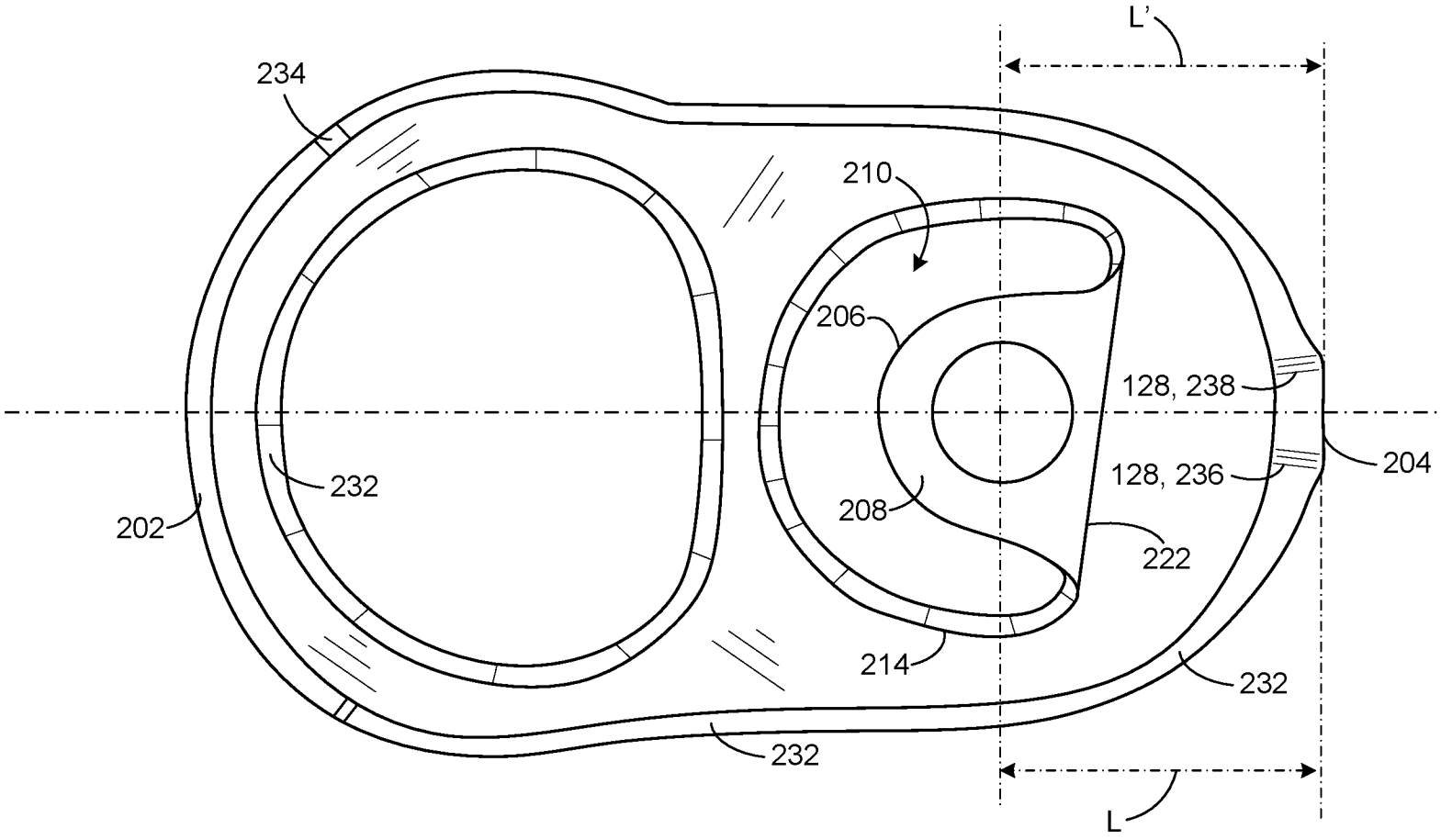
FIG. 2B is a bottom view of the example tab of FIG. 2A.

FIG. 2A is a top view of the tab 104 of FIG. 1. FIG. 2B is a bottom view of the tab 104 of FIG. 2A. Referring to FIGS. 2A and 2B, the tab 104 of the illustrated example includes a lift end 202 and a nose 204. The tab 104 of the illustrated example includes a central webbing 206 located between the lift end 202 and the nose 204. The central webbing 206 of the illustrated example includes a rivet island 208 (e.g., a hinge region) that includes an opening to receive the rivet 126 (FIGS. 1A and 1B). The central webbing 206 of the illustrated example includes an opening or void region 210 that provides an exposed area of the center panel 106 when the tab 104 is coupled to the can end 100. The void region 210 of the illustrated example has a curvilinear geometry that boarders the rivet island 208 and at least partially surrounds the rivet 126 such that the void region 210 of the illustrated example defines a first leg 212 and a second leg 214 different than the first leg 212. The second leg 214 of the illustrated example is positioned on a first side 216 of a longitudinal axis or center axis 218 (e.g., a diametrical line) of the tab 104 and the first leg 212 is positioned on a second side 220 of the center axis 218 opposite the first side 216.

The rivet 126 of the illustrated example enables the lift end 202 to rotate and/or pivot relative to the center panel 106. The rivet island 208 of the illustrated example bends adjacent the rivet 126 across a hinge line 222. In other words, the hinge line 222 provides a fulcrum about which the lift end 202 of the tab 104 pivots relative to the pour panel 120 when the lift end 202 of the tab 104 is lifted away from the center panel 106. The hinge line 222 of the illustrated example is defined by a substantially straight line passing between a terminal end 224 of the first leg 212 and a terminal end 226 of the second leg 214.

The hinge line 222 of the illustrated example intersects the center axis 218 at a non-perpendicular angle (e.g., an oblique angle). Thus, the hinge line 222 of the illustrated example is oriented at the angle (e.g., an oblique angle) that is neither parallel nor perpendicular to the center axis 218. To provide the hinge line 222 at an angle relative to the center axis 218, the first leg 212 of the void region 210 of the illustrated example has a length that is greater than a length of the second leg 214. For example, the terminal end 224 of the first leg 212 of the illustrated example is positioned closer to the nose 204 and the pour panel 120 (FIG. 1A) than the terminal end 226 of the second leg 214.

The hinge line 222 of the illustrated example is at an angle 228 (e.g., a hinge line angle) relative to a reference line 230 (e.g., relative to normal, relative to a horizontal reference line in the orientation of FIG. 2A that is perpendicular to the center axis 218). For example, the angle 228 of the hinge line 222 relative to the reference line 230 is approximately between 4 degrees and 12 degrees. In some examples, the angle 228 of the hinge line 222 relative to the reference line 230 is approximately between 8 degrees and 8.5 degrees. In some examples, the angle 228 of the hinge line 222 relative to the reference line 230 is approximately 8 degrees or 8.5 degrees. When the lift end 202 is lifted, a rotational path of the tab 104 and a downward path of the nose 204 is at an oblique angle relative to the center axis 218 due to the angle 228 of the hinge line 222, and not in alignment with or parallel relative to the center axis 218.

To strengthen the tab 104 and/or hide any sharp edges, the tab 104 of the illustrated example has a curled portion 232 (e.g., having a radius of curvature) about its perimeter. The curled portion 232 is generally about an entire perimeter of the tab 104 with slit portions 234 to accommodate rounded contours of the tab 104 and avoid wrinkling of metal of the tab 104. The curled portion 232 of the illustrated exam pie is at least formed from the terminal end 224 of the first leg 212 to the terminal end 226 of the second leg 214 through the nose 204. The curled portion 232 is formed by rolling downwardly metal from the tab 104.

To enhance openability of the can end 100, the tab 104 of the illustrated example includes the cleats 128. In particular, the tab 104 of the illustrated example includes a first cleat 236 and a second cleat 238. The first cleat 236 of the illustrated example is spaced or separated from the second cleat 238. More specifically, a wall or bridge 240 is positioned between the first cleat 236 and the second cleat 238 (e.g., separates the first cleat 236 and the second cleat 238).

The first cleat 236 and the second cleat 238 of the illustrated example are offset relative to the center axis 218. The first cleat 236 of the illustrated example is positioned on the first side 216 of the center axis 218 and the second cleat 238 of the illustrated example is positioned on the second side 220 of the center axis 218. Specifically, the first cleat 236 and the second cleat 238 are positioned at angles relative to the center axis 218. For example, a longitudinal axis 242 of the first cleat 236 is positioned at a first angle 244 relative to the center axis 218 and a longitudinal axis 246 of the second cleat 238 is positioned at a second angle 248 relative to the center axis 218. In some examples, the first angle 244 and the second angle 248 of the illustrated example are the same as the angle 228 of the hinge line 222. In some examples, the first angle 244 and the second angle 248 of the illustrated example may be approximately within 2 degrees greater than or less than the angle 228 of the hinge line 222. In some examples, the first angle 244 and the second angle 248 may be approximately 4 degrees greater than or less than the angle 228 of the hinge line 222. In some examples, the first angle 244 and the second angle 248 may be approximately within 0.5 degrees of the angle 228 of the hinge line 222. In some examples, the first angle 244 and the second angle 248 of the illustrated example may be different than the angle 228 of the hinge line 222. In some examples, the first angle 244 of the illustrated example may be different than the second angle 248 and/or the angle 228 of the hinge line 222. In some examples, the tab 104 of the illustrated example may only include the first cleat 236 or the second cleat 238.

Additionally, formation of the first and second cleats 236 and 238 forces the curled portion 232 outwardly from the nose 204 in a direction relative to the longitudinal axes 242 and 246, respectively, to effectively lengthen the tab 104 in a direction along the center axis 218. In other words, the first cleat 236 increases a length L of the tab 104 along the center axis 218 from a center of the rivet 126 to the nose 204 of the tab 104 defined by an outermost edge of the first cleat 236. The second cleat 238 increases a length L' of the tab 104 along the center axis 218 from the center of the rivet 126 to the nose 204 of the tab 104 defined by an outermost edge of the second cleat 238. In the illustrated example, the length L is the same as the length L'. However, in some examples, the length L may be different than the length L'. In other words, a longitudinal length of the tab 104 between the rivet 126 and an outermost edge of the first cleat 236 may be longer than a longitudinal length of the tab 104 between the rivet 126 and an outermost edge of the nose 204 aligned or passing through the center axis 218. The increase in length along the center axis 218 and/or along the first cleat 236 and/or the second cleat 238 increases the amount of force to be provided by the tab 104 when the tab 104 is lifted without having to increase material gauge of the tab 104 and/or form a tab having a longer length, which would require additional material and increase material costs.

Figure 3:
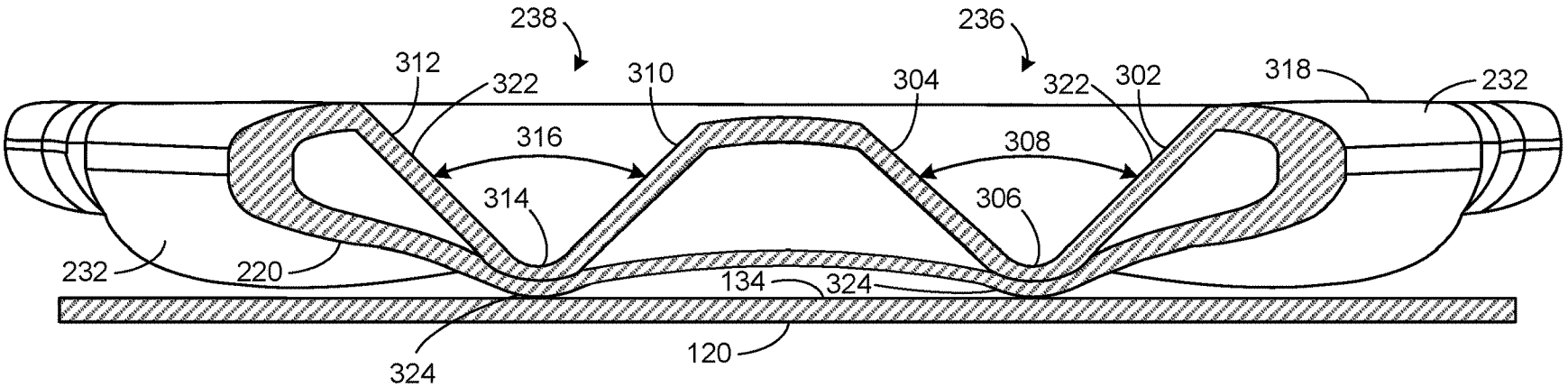
FIG. 3 is a cross-sectional view of the example tab of FIGS. 1A, 1B, 2A and 2B taken along line 3-3 of FIG. 2A.

FIG. 3 is a cross-sectional view of the nose 204 of the tab 104 taken along line 3-3 of FIG. 2A. The first cleat 236 of the illustrated example has a first wall 302 and a second wall 304 separated by a bottom area 306 (e.g., a V-shaped profile). The bottom area 306 of the illustrated example is a curved segment with a radius of curvature, rather than a sharp point having a substantially smaller radius of curvature. The first wall 302 and the second wall 304 may form an angle 308 of approximately between 5 degrees and 70 degrees.

The second cleat 238 of the illustrated example is substantially similar to the first cleat 236. For example, the second cleat 236 of the illustrated example has a first wall 310 and a second wall 312 separated by a bottom area 314 (e.g., a V-shaped profile). The bottom area 314 of the illustrated example is a curved segment with a radius of curvature, rather than a sharp point having a substantially smaller radius of curvature. The first wall 310 and the second wall 312 may form an angle 316 of approximately between 5 degrees and 70 degrees.

The first and second cleats 236 and 238 of the illustrated example are formed by striking (e.g., stamping) an upper surface 318 of the tab 104. This compresses the curled portion 232 at the upper surface 318 and forces a bottom surface 320 of the tab 104 downwardly. Thus, each of the first cleat 236 and the second cleat 238 of the illustrated example has an upper surface 322 exhibiting a V-shaped crevice and a lower surface 324 extending downwardly towards the outer surface 134 of the pour panel 120. The lower surface 324 of the respective first and second cleats 236 and 238 differs structurally from the upper surface 322. The lower surface 324 forms a bow-shaped surface transverse to the center axis 218 rather than the V-shape exhibited by the upper surface. This structural characteristic also reduces an angle or distance between the lower surface 324 of the tab 104 and the outer surface 134 of the pour panel 120, providing a shorter path to contact between the tab 104 and the pour panel 120 during opening and reducing some rocking of the tab 104 on the rivet 126.

Figure 4:
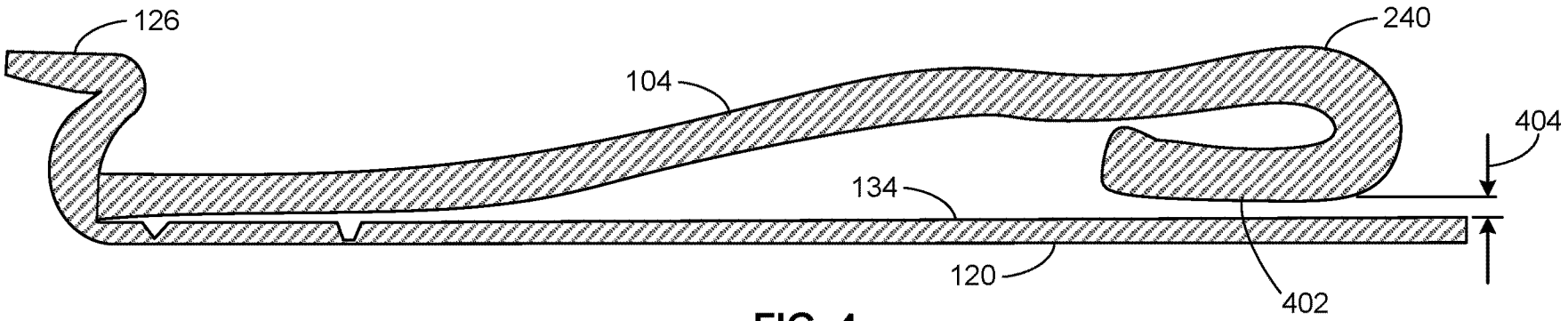
FIG. 4 is a cross-sectional view of the example tab of FIGS. 1A, 1B, 2A and 2B taken along line 4-4 of FIG. 2A.
Figure 5:
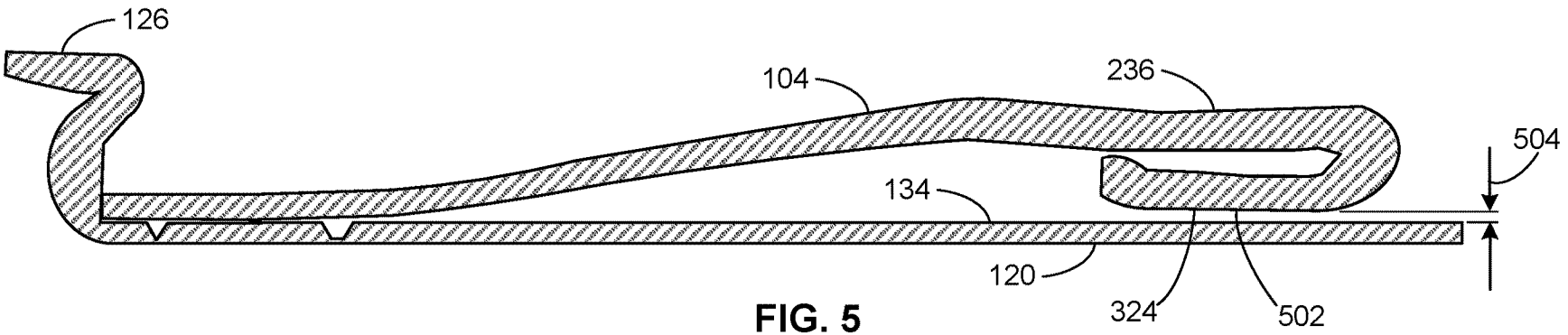
FIG. 5 is a cross-sectional view of the example tab of FIGS. 1A, 1B, 2A and 2B taken along line 5-5 of FIG. 2A.

FIG. 4 is a partial, cross-sectional view of the can end 100 taken along line 4-4 of FIG. 2A. Referring to FIG. 4, a bottom surface 402 of the bridge 240 is spaced from the outer surface 134 of the pour panel 120 at a distance 404 (e.g., between 2 and 3 millimeters). The bottom surface 402 of the illustrated example is substantially planar or flat. In other words, the bottom surface 402 is substantially parallel relative to the outer surface 134 of the pour panel 120. In this manner, the bottom surface 402 of the tab 104 of the illustrated example is substantially planar or flat to restrict (e.g., prevent) the tab 104 from sliding (e.g., backwards) relative to the outer surface 134 of the pour panel 120 and towards the rivet 126 (e.g., prevents tab tuck under). FIG. 5 is a cross-sectional view of the can end 100 taken along line 5-5 of FIG. 2A. Referring to FIG. 5, a bottom surface 502 of the lower surface 324 of the first cleat 236 is spaced from the outer surface 134 of the pour panel 120 by a distance 504 (e.g., between 0.5 and 2 millimeters), which is significantly less than the distance 404 of FIG. 4. Thus, the distance 504 between the bottom surface 502 of the tab 104 and the outer surface 134 of the pour panel 120 is reduced by the first cleat 236. In this manner, the first cleat 236 engages the pour panel 120 prior to adjacent portions of the nose 204 when the lift end 202 of the tab 104 is raised or lifted in a direction away from the center panel 106. This structural characteristic also results in less tab pull travel to achieve contact between the tab 104 and the pour panel 120 during opening to provide a reduced pop angle (e.g., FIGS. 8A and 8B) and/or reducing some rocking of the tab 104 on the rivet 126. Additionally, although not shown, a distance between a bottom surface of the second cleat 238 and the outer surface 134 is the same as the distance 504. Additionally, the bottom surface 502 of the first cleat 236 is substantially flat or planar to provide an increased frictional force to restrict (e.g., prevent) the tab 104 from sliding (e.g., backwards) relative to the outer surface 134 of the pour panel 120 and towards the rivet 126 (e.g., prevents tab tuck under) when the lift end 202 is lifted away from the center panel 106.

Figure 6A:
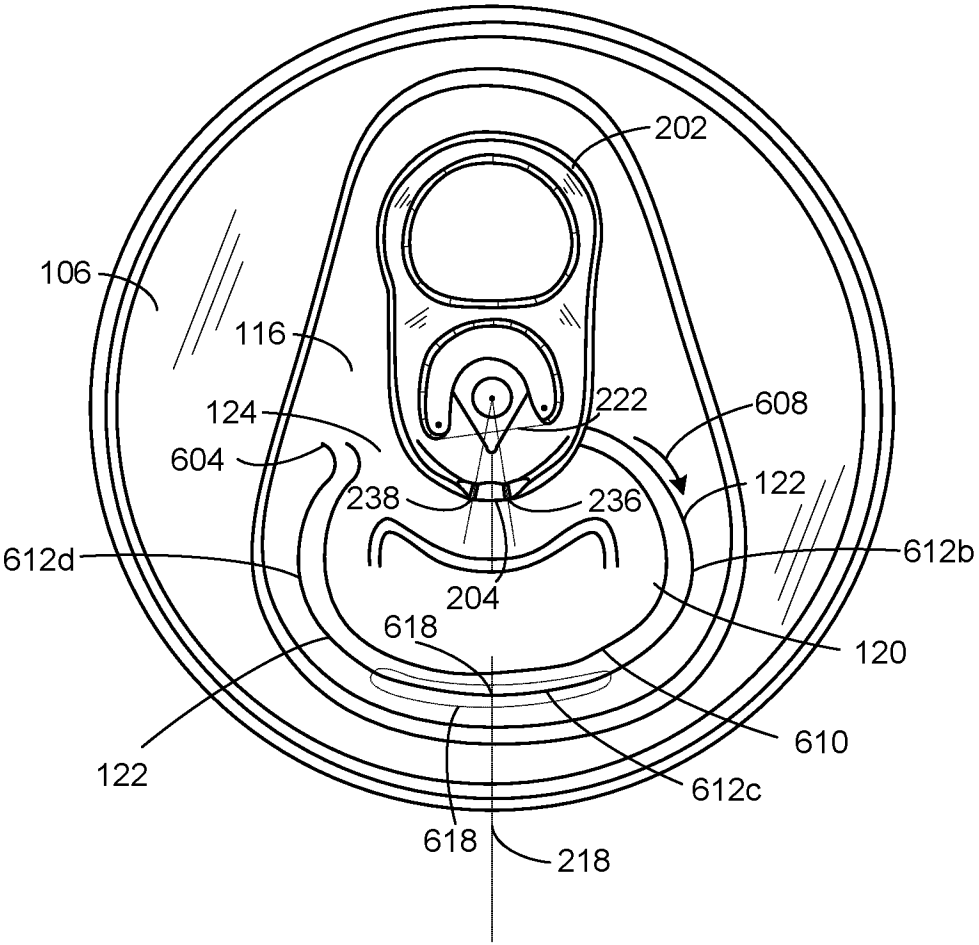
FIG. 6A is a top view of the example can end of FIGS. 1A and 1B.
Figure 6B:
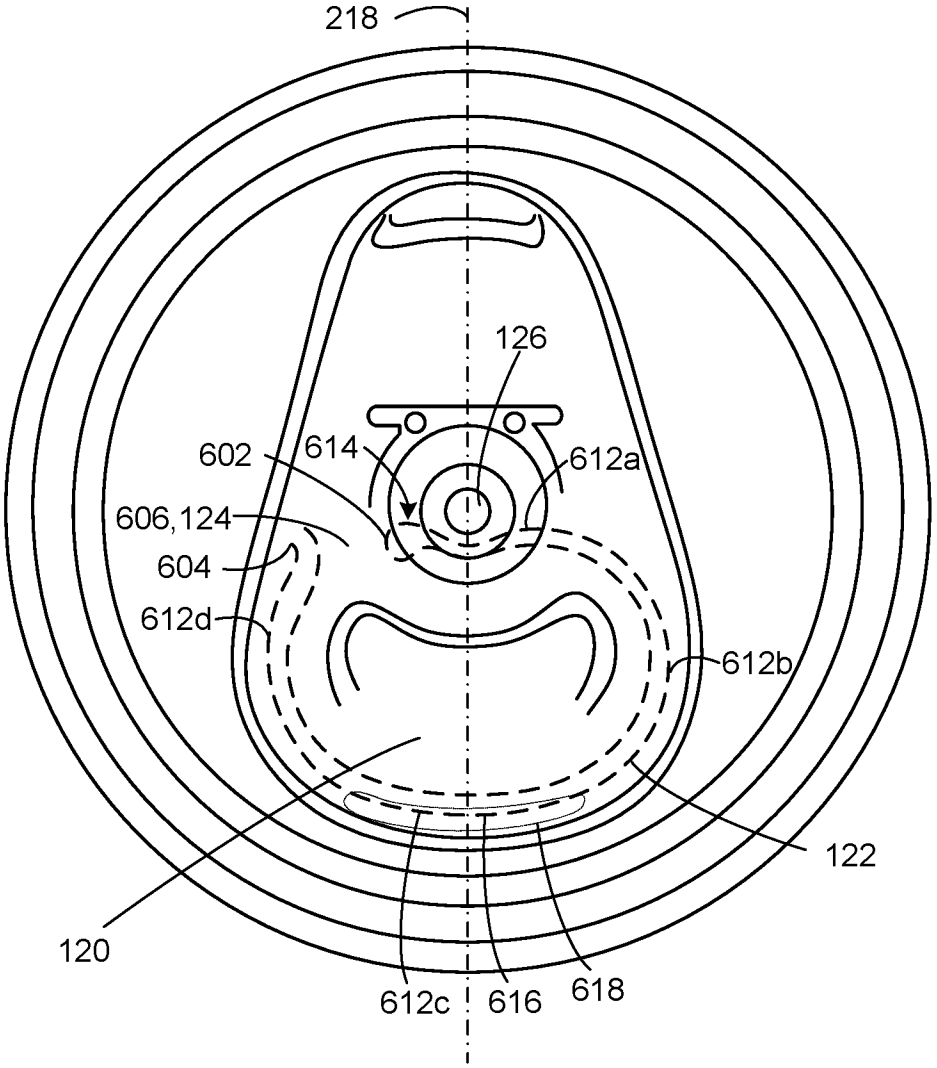
FIG. 6B is a bottom view of the example can end of FIGS. 1A and 1B.

FIG. 6A is a top view of the example can end 100 of FIGS. 1A-1B, 2A-2B, and 3-5. FIG. 6B is a bottom view of the example can end 100 of FIGS. 1A-1B, 2A-2B, and 3-5. The pour panel 120 of the illustrated example is defined by the frangible score 122 that surrounds the pour panel 120. The frangible score 122 of the illustrated example has a generally curvilinear profile extending between a first end 602 and a second end 604. A portion 606 of the deboss panel 116 positioned between the first end 602 and the second end 604 of the frangible score 122 forms the non-frangible hinge 124. The frangible score 122 of the illustrated example ruptures from the first end 602 and propagates along the frangible score 122 to the second end 604 in a clockwise direction 608 in the orientation of FIG. 6A.

A non-frangible score 610 is provided adjacent, but spaced relative to, the frangible score 122. The non-frangible score 610 does not separate from the center panel 106 to provide a pour opening. On the contrary, the non-frangible score 610 is provided to restrict can end material flow during a scoring operation when forming the frangible score 122. To open the pour panel 120, the pour panel 120 is severed from the center panel 106 along the frangible score 122 rather than the non-frangible score 610, which is not severed.

Referring to FIG. 6B, the pour panel 120 of the illustrated example includes a first segment 612*a* at least partially positioned under the nose 204. The first segment 612*a* of the illustrated example defines a vent region 614. The vent region 614 is a portion of the frangible score 122 that initially fractures during opening of the pour panel 120 to vent pressure from the container 102 prior to displacing the pour panel 120 relative to the center panel 106. The frangible score 122 of the illustrated example further includes a curvilinear second segment 612*b* extending from the first segment 612*a* toward an outer peripheral edge 616 of the pour panel 120. The second segment 612*b* of the illustrated example is between a 3:00 to 4:00 clock position in the orientation of FIG. 6A (e.g., with the rivet 126 and the nose 204 being in the 12:00 o'clock position and a point at an outermost portion of the pour panel 120 intersecting the center axis 218 at the 6:00 o'clock position). The second segment 612*b* of the illustrated example leads to a curvilinear third segment 612*c* within a transition region 618. The transition region 618 of the illustrated example is approximately between a 5:00 to 7:00 o'clock position. A fourth segment 612*d* continues from the third segment 612*c* through the reminder of the frangible score 122 and terminates adjacent the hinge 124. During opening, the pour panel 120 initially ruptures (e.g., the score 122 is severed) in the vent region 614 of the frangible score 122 of the pour panel 120. After the frangible score 122 is severed in the vent region 614, the sever in the frangible score 122 propagates in sequence through the second segment 612*b,* the third segment 612*c,* and the fourth segment 612*d,* in the clockwise direction 618.

The initial rupture of the frangible score 122 is primarily caused by a lifting force imparted to the tab 104 (e.g., via a finger of a person) resulting in lifting of a central region of the center panel 106 immediately adjacent the rivet 126 that causes separation of the residual metal of the frangible score 122. The force required to rupture the frangible score 122 in the vent region 614, typically referred to as the "pop" force, is less than a force required to propagate or sever the other segments 612*b-d* of the frangible score 122. Therefore, it is preferable that the center panel 106 in an area around the rivet 126 only lifts enough to assist with initial score rupture, or "pop," of the vent region 614 and remains substantially stiff and flat to provide the needed leverage for the tab 104 to propagate the tear through the remaining segments 612*b-d* of the frangible score 122. To continue the rupturing the frangible score 122 after the initial "pop" or venting of the pour panel 120, a push or opening force (e.g., a tear force) is provided by lifting the lift end 202 of the tab 104 away from the center panel 106 and about the hinge line 222 to cause the nose 204 to push downwardly against the pour panel 120.

The opening force required to rupture the frangible score 122 is greater than the pop force required to rupture the vent region 614 of the pour panel 120. Specifically, the frangible score 122 in certain regions or areas of the large-open pour panel such as, for example, the pour panel 120 may be more difficult to open by the tab 104 leveraging against the pour panel 120. For example, certain regions of the frangible score 122 may require a greater amount of force to rupture or sever than other regions of the frangible score 122. For example, the second segment 612*b* (e.g., a 3:00 o'clock position) and/or the transition region 618 of a large-open pour panel may require the greatest amount of force to sever the frangible score 122. In some examples, a peak opening force may be required to sever the pour panel 120 at the 3 o'clock position (e.g., the second segment 612*b*). In some examples, the transition region 618 of the frangible score 122 may exhibit a relatively large resistance to the opening force when the lift end 202 is lifted, at least partly due to the curvilinear geometry of the frangible score 122, the large-open pour panel being substantially wider than the tab 104, and/or the nose 204 being at a greatest distance from the transition region 618. In some examples, although a peak opening force may not be required to sever the fourth segment 612*d,* a significant opening force may be required to sever the fourth segment 612*d* due to the width and/or size of the pour panel 120 (e.g., a width in the horizontal direction, a distance between the 3 o'clock position and the 9 o'clock position) and the relatively narrow or smaller width of the tab 104.

Additionally, larger opening forces required to open large-open pour panels such as, for example, the pour panel 120 and/or larger score residuals, may increase a possibility of opening failure that results in "tuck under" of the tab 104. This type of opening failure occurs when the nose 204 of the tab 104 slips relative to the pour panel 120 in a direction toward the rivet 126 when the lift end 202 of the tab 104 is pivoted away from the center panel 106. As noted above, simply increasing a length of the tab 104 will significantly increase manufacturing costs due to increased material(s) needed to manufacture a longer tab 104 and/or may not fit certain size can ends (e.g., the 202 size can end). Further, making the nose 204 a flat or blunt surface (e.g., smash nose) (e.g., making a wide cleat that encompasses the first and second cleats 236 and 238 in width in the orientation of FIG. 6A) may cause the nose 204 to weaken or lose strength, thereby requiring the nose 204 to have a thicker dimensional profile provided by additional material, thereby increasing manufacturing costs. In some instances, a tab may not have enough material (e.g., material gauge) to support a smash configuration.

The first and second cleats 236 and 238 of the illustrated example provide increased opening forces to open the pour panel 120. Such increased opening forces provided by the first and second cleats 236 and 238 enable the tab 104 to have a smaller dimensional profile or footprint (e.g., a tab with less material) than conventional tabs. Specifically, the increased opening forces provided by the first and second cleats 236 and 238 of the illustrated example reduce the likelihood of opening failure when employed with frangible scores having larger score residuals. Also, as the industry continually seeks to downgauge the metal of the tab 104 (e.g., use thinner gauge material to reduce costs), increased efficiency in opening by the tab 104 permits the use of a tab made of thinner and/or less material.

The first cleat 236 of the illustrated example is offset relative to the center axis 218 to engage the first side 216 of the pour panel 120 adjacent the first segment 612*a* and the second segment 612*b* of the frangible score 122. In this manner, due to the fulcrum provided by the hinge line 222 and the offset position of the first cleat 236, the first cleat 236 of the illustrated example directs an opening force toward the first side 216 of the center axis 218 of the tab 104. In other words, the offset of the first cleat 236 and the distance 504 ensures that the first cleat 236 imparts an initial opening force to the pour panel 120. More specifically, the first cleat 236 engages the pour panel 120 at an angle provided by the hinge line 222 and directs an opening force offset relative to the center axis 218 by the first angle 244 in a direction toward the second segment 612*b* and the third segment 612*c* of the pour panel 120 when the tab 104 is lifted and pivoted about the hinge line 222. Thus, the first cleat 236 provides or directs an increased opening force (e.g., a peak opening force) toward the second segment 612*b* and an opening force to the third segment 612*c* of the frangible score 122. Thus, when the first cleat 236 is engaged with the pour panel 120, the first cleat 236 provides an increased opening force and/or pressure to rupture the frangible score 122 from the first segment 612*a* (e.g., the vent region 614), the second segment 612*b* and/or the third segment 612*c* (e.g., through the transition region 618). Additionally, the nose 204 (e.g., the bridge 240) imparts an opening force to the pour panel 120 as the frangible score 122 ruptures through the transition region 618.

Similarly, the second cleat 238 of the illustrated example is offset to the second side 220 relative to the center axis 218 to direct or concentrate an opening force on the pour panel 120 in a direction towards the second side 220 of the center axis 218. As the first cleat 236 applies or directs an opening force toward the second and third segments 612*b-c* of the frangible score 122 (e.g., between the 3:00 and 7:00 o'clock positions), the second cleat 238 applies or directs a concentrated high pressure toward the fourth segment 612*d* of the frangible score 122 (between the 9:00 and 11:00 o'clock positions). After the transition region 618 is ruptured, the second cleat 238 continues to apply an opening force to the pour panel 120 to rupture the frangible score 122 along the fourth segment 612*d* to the second end 604 of the frangible score 122. In some instances, in addition to directing or concentrating an opening force toward the fourth segment 612*d*, the second cleat 238 aids the first cleat 236 to rupture the transition region 618 of the frangible score 122.

Thus, in operation, the first cleat 236 initially contacts or engages (e.g., grabs) the pour panel 120 to rupture the frangible score 122 along the second and third segments 612*b-d* (the transition region 618) and the second cleat 238 contacts or engages the pour panel 120 to finish rupturing the frangible score 122 along the fourth segment 614*d* to the second end 604 as the nose 204 rolls over the pour panel 120 to open the pour panel 120. The first and second cleats 236 and 238 provide the increased opening force due to an increase in frictional force between the bottom surfaces 502 of the respective first and second cleats 236 and 238 and the outer surface 134 of the pour panel 120. In some examples, the first and second cleats 236 and 238 grip the outer surface 134 of the pour panel 120 with greater amount of resistance to nose slippage when the lift end 202 is lifted. By preventing or restricting slippage between the nose 204 and the outer surface 134 of the pour panel 120, the first and second cleats 236 and 238 can impart a greater amount of opening force to the pour panel 120 (e.g., which can open more difficult or larger residual scores).

Figure 7:
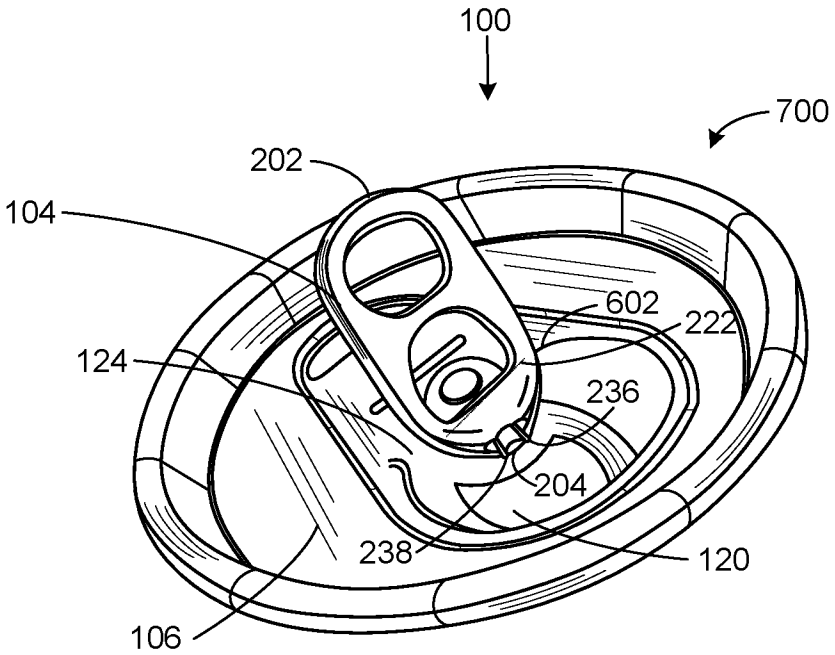
FIG. 7 is a perspective view of the example can end of FIGS. 1A and 1B shown in a partially open position.

FIG. 7 illustrates the pour panel 120 in a partially open position 700 relative to the center panel 106. When the lift end 202 of the tab 104 is lifted away from the center panel 106, the tab 104 pivots about the hinge line 222. As the tab 104 is lifted, due to the angle of the hinge line 222 relative to the center axis 218 of the tab 104, a rotational path of the tab 104 and the nose 204 is likewise at an angle relative to the hinge line 222. In this manner, the tab 104 pivots at an angle relative to the center axis 218 of the tab 104 and causes the nose 204 and the first cleat 236 to impart an opening force directed to the first side 216 of the center axis 218 of the tab 104. In this manner, the pour panel 120 begins to rupture at the first end 602 and the frangible score 122 continues to propagate as the lift end 202 of the tab 104 is rotated away from the center panel 106. As the opening operation is continued, the pour panel 120 is displaced downward and is rotated about the hinge 124 to be deflected into the container 102 (FIG. 1).

Figure 8A:
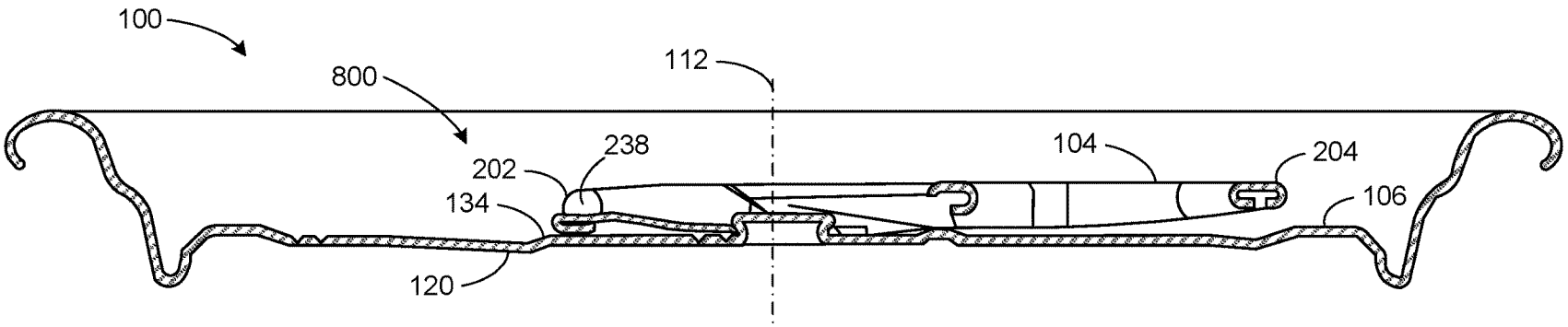
FIG. 8A is a cross-sectional view of the example can end of FIGS. 1A and 1B shown in a closed position.
Figure 8B:
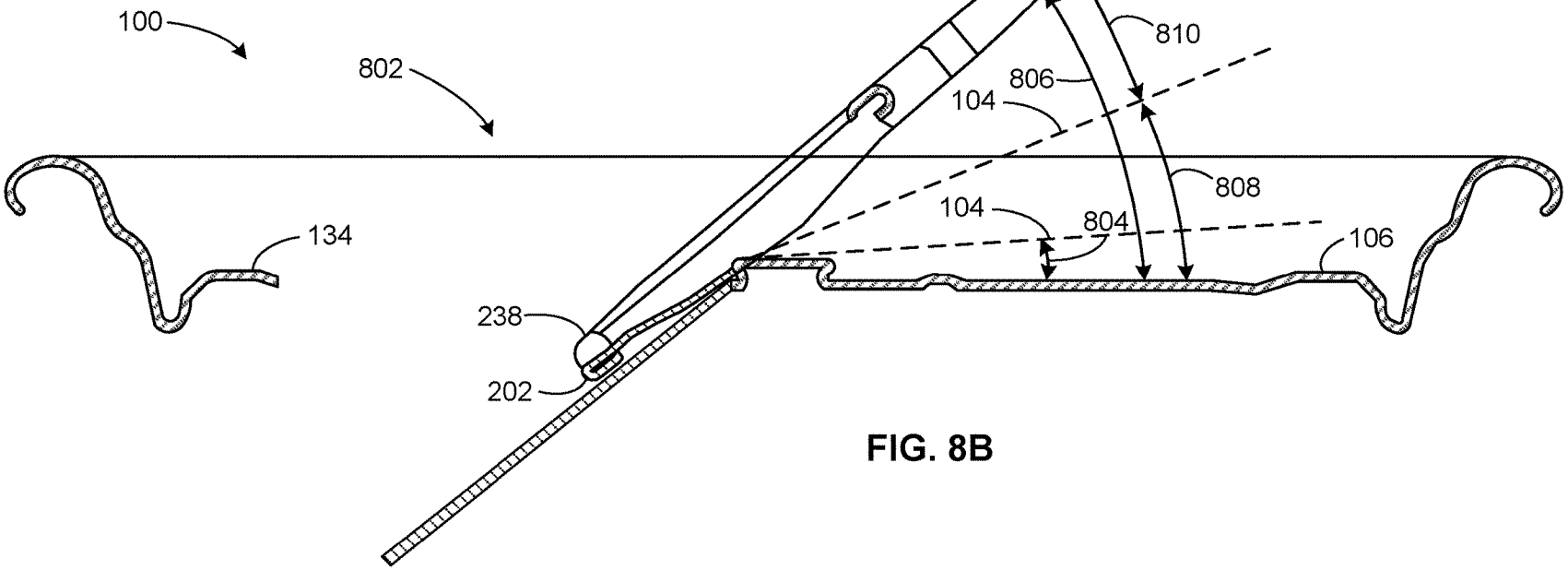
FIG. 8B is a cross-sectional view of the example can end of FIGS. 1A and 1B shown in a fully open position.

FIG. 8A illustrates a cross-sectional view of the example can end 100 showing the pour panel 120 in a closed position 800 (e.g., a non-ruptured condition). FIG. 8B illustrates a cross-sectional view of the example can end 100 showing the pour panel 120 in an open position 802 (e.g., a ruptured condition). To rupture the vent region 614 (e.g., provide a pop force required to sever the region of the frangible score 122 defining the vent region 614), the lift end 202 of the tab 104 is pivoted away from the center panel 106 a rotational distance defined by a pop angle 804. The tab 104 of the illustrated example, due to the opening force provided by the first and second cleats 236 and 238, enables the pop angle 804 to be less than a pop angle of conventional tabs without the cleats. The pop angle 804 is an angle that the lift end 202 of the tab 104 needs to rotate relative to the center panel 106 to rupture the vent region 614 of the pour panel 120.

Decreasing the pop angle 804 of the tab 104 provides a greater amount of rotational distance for the tab 104 to apply the opening force before the tab reaches a termination angle 806. The termination angle 806 is an angle at which the opening force (e.g., a leverage force) provided by the tab 104 to the pour panel 120 decrease (e.g., decrease to almost zero pounds). Thus, the termination angle 806 occurs when the pour panel 120 completely opens and no longer provides resistance against the tab 104. At this point, the pour panel 120 should be ruptured along the entire frangible score 122. Thus, if the tab 104 reaches the termination angle 806 and the pour panel 120 is not in the fully open position 802 (e.g., in the partially open position 700 of FIG. 7), the tab 104 may be ineffective to move the pour panel 120 to the fully open position 802. Thus, it is desirable to move the pour panel 120 to the fully open position 802 prior to the tab 104 reaching the termination angle 806. For example, the termination angle 806 of the illustrated example may be approximately between 70 and 80 degrees relative to the center panel 106

(e.g., horizontal). In some instances, if the pour panel 120 is not in the fully open position 802 when the tab 104 reaches the termination angle 806, the nose 204 may flip open and the tab 104 will not move the pour panel 120 to the fully open position 802.

During opening of the pour panel 120, the first cleat 236 of the illustrated example concentrates or directs the opening force of the tab 104 to the first side 216 of the center axis 218 of the tab when the lift end is rotated, for example, between an initial position (e.g., a zero-degree position, a position shown in FIG. 8A, etc.) and a first angular position 808. The first angular position 808 of the illustrated example may be an angle at which the frangible score 122 ruptures through the transition region 618. The second cleat 238 of the illustrated example concentrates or directs the opening force of the tab 104 to the second side 220 of the center axis 218 of the tab 104 when the lift end 202 is rotated, for example, between the first angular position 808 and a second angular position 810 different than the first angular position 808. The second angular position 810 of the illustrated example may be an angle at which the frangible score 122 ruptures from (e.g., an end of) the transition region 618 to the second end 604 of the frangible score 122 (e.g., the fully open position 802). In some examples, the second angular position 810 is the termination angle 806. In other words, the first cleat 236 of the illustrated example concentrates or directs the opening force to open or rupture the frangible score 122 through the second segment 612*b* and/or the transition region 618, and the second cleat 238 of the illustrated example concentrates or directs the opening force to open or rupture the frangible score 122 from the transition region 618 to the second end 604 (e.g., the fourth segment 612*d*) as the nose 204 (or generally the tab 104) rotates or pivots about the vertical axis 112 of the rivet 126. Such rotation about the vertical axis 112 is due to the hinge line 222 being at the non-perpendicular angle relative to the center line 218.

Further, as noted above in connection with FIGS. 4 and 5, the bottom surface 502 of the first cleat 236 (and the lower surface of the second cleat 238) are immediately adjacent the pour panel 120. In this manner, to cause the first and second cleats 236 and 238 and/or the nose 204 to engage the pour panel 120, the lift end 202 of the tab 104 can be pivoted a relatively small angular rotation relative to the center panel 106. As a result, the first and second cleats 236 and 238 do not affect (e.g., increase) an amount of travel of the lift end 202 to achieve the termination angle 806 of the tab 104. For example, rotation of the lift end 202 relative to the center panel 106 between approximately less than one degree and 2 degrees causes the bottom surface 502 of the respective first and second cleats 236 and 238 to engage the outer surface 134 of the pour panel 120.

Table 1 provides sample results of open force and tab strength summary of conventional tabs formed without cleats and employed with 202 LOE B64 size can ends. A 202 LOE B64 size can end typically has a diameter of approximately 59.44 millimeters (e.g., 2.34 inches).

TABLE 1

| TAB WITHOUT CLEATS | | | | | |
|---|---|---|---|---|---|
| | POP [LBS] | POP ANGLE | PUSH [LBS] | PUSH ANGLE | TAB STR [LBS] |
| SAMPLE SIZE | 10 | 10 | 10 | 10 | 10 |
| MIN | 3.05 | 20.16 | 3.63 | 41.94 | 6.71 |
| MAX | 3.35 | 22.50 | 3.93 | 58.50 | 6.87 |

TABLE 1-continued

| TAB WITHOUT CLEATS | | | | | |
|---|---|---|---|---|---|
| | POP [LBS] | POP ANGLE | PUSH [LBS] | PUSH ANGLE | TAB STR [LBS] |
| AVG | 3.19 | 21.06 | 3.77 | 53.77 | 6.77 |
| STDEV | 0.09 | 0.65 | 0.10 | 4.69 | 0.05 |

Table 2 provides open force and tab strength summary of tabs (e.g., the tab 104) of the illustrated example employed with 202 LOE B64 size can ends.

TABLE 2

| TAB WITH CLEATS | | | | | |
|---|---|---|---|---|---|
| | POP [LBS] | POP ANGLE | PUSH [LBS] | PUSH ANGLE | TAB STR [LBS] |
| SAMPLE SIZE | 10 | 10 | 10 | 10 | 10 |
| MIN | 3.32 | 18.00 | 3.79 | 40.32 | 6.66 |
| MAX | 3.62 | 20.52 | 3.95 | 51.48 | 6.96 |
| AVG | 3.50 | 19.55 | 3.89 | 47.84 | 6.82 |
| STDEV | 0.11 | 0.84 | 0.06 | 2.94 | 0.11 |

A comparison of Tables 1 and 2 reveals that the score residual 130 of the illustrated example may increase a pop force required to rupture the pour panel 120 (e.g., because the residual score is greater than conventional residual scores of conventional can ends and/or the greater resistance (e.g., frictional force) provided by the first and second cleats 236 and 238). However, although a greater pop force is needed, the tab 104 of the illustrated example reduces a pop angle (e.g., the pop angle 804) required to rupture the vent region 614 (e.g., due to the increased opening force provided by the first and second cleats 236 and 238). The tab 104 of the illustrated example provides an average pop angle that is less than a pop angle of the conventional tab. Further, the tab 104 of the illustrated example provides an average push or opening force that is greater than an average push force of the conventional tab (e.g., due to the first and second cleats 236 and 238). Thus, in comparison to the conventional tabs, the first and second cleats 236 and 238 of the illustrated example reduce a pop force angle and provide a greater amount of opening force as the score rupture propagates between the first end 602 and the second end 604 to displace the tab 104 to the fully open position 802 prior to reaching the termination angle 806. Moreover, the tab 104 of the illustrated example provides an average tab strength that is greater than an average tab strength of the conventional tab. The reduction in pop angle 804 may be provided during manufacturing of the tab 104 as described below in correlation with in FIG. 9.

Thus, the tab 104 of the illustrated example provides manufacturers with greater flexibility by enabling a larger range of depths of the score residual 122 of the pour panel 120, thereby enabling use of the can end 100 for different applications. For example, the tab 104 of the illustrated example may be employed with pour panels of LOEs having a greater range residual scores than residual scores of conventional LOEs. Additionally, the tab 104 of the illustrated example may be employed with different types of can ends (e.g., having different blank sizes and/or metal gauge ranges). For example, the tab 104 of the illustrated example may be employed with different types of can ends such as, for example, B64 type can ends, CDL (Container Development Limited) type can end and/or any other suitable type of can end(s). Additionally, the tab 104 of the illustrated example may be employed with different size can ends including, but not limited to, 200 size can ends, 202 size can ends, 204 size can ends, 206 size can ends, 207.5 size can ends, 209 size can ends and/or any other suitable size can end(s).

Figure 9:
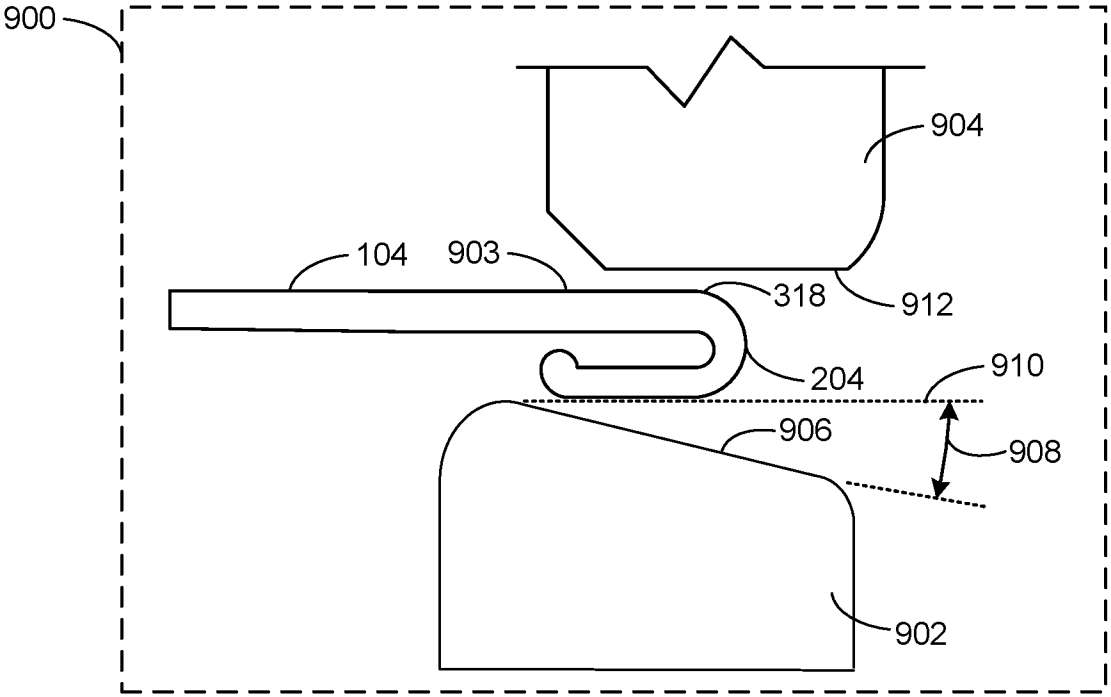
FIG. 9 is a schematic illustration of an example die assembly that may be used to form the example tab of FIGS. 1A, 1B, 2A, 2B, 3-5, 6A, 6B, 7, 8A and 8B.

FIG. 9 illustrates an example die assembly 900 for manufacturing the one or more cleats 128 of the tab 104. The container 102 of FIG. 1 is typically a drawn and ironed metal can, usually constructed from a thin plate of aluminum or steel. A beverage can end (e.g., such as the can end 100) is typically constructed from a cutedge of thin plate of aluminum or steel, formed into a blank end, and manufactured into a finished end by a process often referred to as end conversion. For example, the can end 100 may be manufactured in a series of progressive die presses that initially form the basic can end configuration or shell. Subsequently, the shell has various operations performed thereon, such as embossing, debossing, scoring, rivet formation and tab staking, to complete the end. Can ends may be made of aluminum or tin-plated steel.

The tab 104 of the illustrated example is manufactured separately from the can end 100. For example, the tab 104 of the illustrated example may be made from a narrow coil of aluminum or steel. The coil or strip is first pierced and cut. Then the tab 104 is formed in two further stages before being joined to the can end 100. To form the tab 104, a strip of aluminum or steel is fed into a progressive die press. In some examples, the progressive die may include a plurality of dies (e.g., between eight and seventeen dies) in the die press that are taken progressively, with the first die making a little indentation in the strip, the second die making a further indentation, another die or roll former to curl the perimeter of the tab (e.g., the curled portion 232) and so on so that by the time the strip gets through the last set of dies, the tab 104 is formed. After formation of the tab 104, the tab 104 of the illustrated example is staked to the center panel 106 via the rivet 126.

One of the steps in the progressive die may be a stamping process to form the first and second cleats 236 and 238. Specifically, after the perimeter of the tab 104 is curled to form the curled portion 232 and prior to staking the tab 104 to the can end 100, the first and second cleats 236 and 238 of the illustrated example are formed by striking the upper surface 318 of the tab 104.

The die assembly 900 of the illustrated example may provide the first and second cleats 236 and 238. The die assembly 900 of the illustrated example includes a die 902 (e.g., a die reform) and a punch 904 (e.g., a punch tip). The die 902 of the illustrated example supports a body or portion 903 (e.g., the nose 204) of the tab 104 when the punch 904 strikes the upper surface 318 of the tab 104 to form the first and second cleats 236 and 238. After forming the first and second cleats 236 and 238, a dimensional accuracy of the tab 104 may be affected by springback. Typically, springback occurs when a material tries to return to an original shape after being bent. The final form of a part may be changed by springback, which makes it difficult to produce the part with tight manufacturing tolerances. For example, tensile strength and thickness of the material, the type of tooling, and/or the type of bending may greatly influence springback.

To accommodate or compensate for springback during manufacturing of the one or more cleats 128 (e.g., the first and second cleats 236 and 238), the die 902 of the illustrated example has an angled or canted support surface 906. Specifically, the support surface 906 of the die 902 is at an angle 908 relative to a reference line or normal 910 (e.g., the reference line 910 being horizontal in the orientation of FIG. 9). For example, the support surface 906 may be a negative angle relative to normal 910 (e.g., an angle away from the nose 204 of the tab 104). The angle 908 of the support surface 906 may be approximately between 5 degrees and 20 degrees relative to normal 910.

Compensating for springback during manufacturing of the one or more cleats 128 (e.g., the first and second cleats 236 and 238) via the die 902 of the illustrated example enables a reduction in the pop angle 804. Specifically, controlling springback provides the distance 404 between the bottom surface 402 of the bridge 240 of the nose 204 and the outer surface 134 of the pour panel 120 and/or provides the distance 504 between the bottom surface 502 of the first and second cleats 236 and 238 and the outer surface 134 of the pour panel 120. Absent a control in springback provided by the die assembly 900, the distance 404 and/or the distance 504 may be greater, thereby increasing a pop angle required to rupture the vent region 614 and, thus, reducing an amount of angular rotation about the hinge line 222 to reach the termination angle 806, which may cause the pour panel 120 to partially open.

When the punch 904 of the illustrated example strikes the upper surface 318 of the tab 104 to form the cleats 128, the body 903 (e.g., the nose 204) of the tab 104 deflects downwardly relative to normal 910. In other words, at least the nose 204 of the tab 104 is bent downwardly beyond normal 910 when the punch 904 strikes the upper surface 318 of the nose 204 of the tab 104. When the punch 904 is removed from the upper surface 318 after formation of the one or more cleats 128, springback causes the body of the tab 104 to return to near normal 910 (e.g., have a slightly negative (downward) angle of approximately between zero to negative five degrees relative to normal 910). In other words, the angled support surface 906 of the illustrated example causes a pre-bend in the tab 104 that compensates for springback.

On the contrary, failing to compensate for springback may cause the body 903 of the tab 104 to return to an initial position that is above normal 910 when employing a die having a substantially planar support surface to form the one or more cleats 128. As a result of employing a die having a substantially straight support surface, the distance 404 between the bottom surface 402 of the bridge 240 portion of the nose 204 and the outer surface 134 of the pour panel 120 and/or the distance 504 between the bottom surface 502 of the first and second cleats 236 and 238 and the outer surface 134 of the pour panel 120 may be greater, resulting in an increase in the pop angle 804 and/or reduction of the opening force.

Additionally, the die assembly 900 of the illustrated example provides the tab 104 with an arcuate profile (e.g., slightly downwardly bent profile). For example, because the nose 204 of the illustrated example is formed with an arcuate profile, the nose 204 is positioned closer to the rivet 126 compared to a tab having a substantially straight (e.g., a non-arcuate) profile when the tab 104 is staked to the can end 100. In this manner, the arcuate profile may accommodate structural changes of the center panel 106 that may result during, for example, transportation, pasteurization, etc. For example, the center panel 106 may dome due to pressure fluctuations inside the container 102, which may cause the center panel 106 and/or the pour panel 120 to have a bent (e.g., a downward) shape or profile. In such instances, the arcuate profile of the tab 104 of the illustrated example enables the nose 204 to deflect or bend toward the center panel 106 and/or the pour panel 120 to maintain the distances 402 and 502 and, thus, maintain the pop angle 804.

Thus, formation of one or more cleats 128 provides a nose (e.g., the nose 204) of a tab (e.g., the tab 104) with an arcuate profile relative to normal to maintain the nose at a predetermined distance (e.g., the distances 402 and/or 502) from the center panel when the center panel has at least one of a first structural profile or a second structural profile different than the first structure profile. For example, the first structural profile is provided during manufacturing and the second structural profile may be due to a dome effect caused during transportation, handling, pasteurization, etc.

The punch 904 of the illustrated example may include a face 912 that may be configured to provide the one or more cleats 128. For example, the face 912 may have a profile to provide the first cleat 236, the second cleat 238 and the bridge 240. For example, the punch 904 may include a face having a first protrusion positioned at the angle 246 relative to a center axis of the die face and a second protrusion positioned at the angle 248 relative to the center axis of the die face, where the first and second protrusions have dimensional characteristics, profiles, or shapes corresponding to the respective first and second cleats 236 and 238. In some examples, the face 912 may be configured to provide only one cleat to the tab 104 or more than two cleats to the tab 104. In some examples, the face 912 may be configured to provide a single cleat aligned with the center axis 218.

Figure 9A:
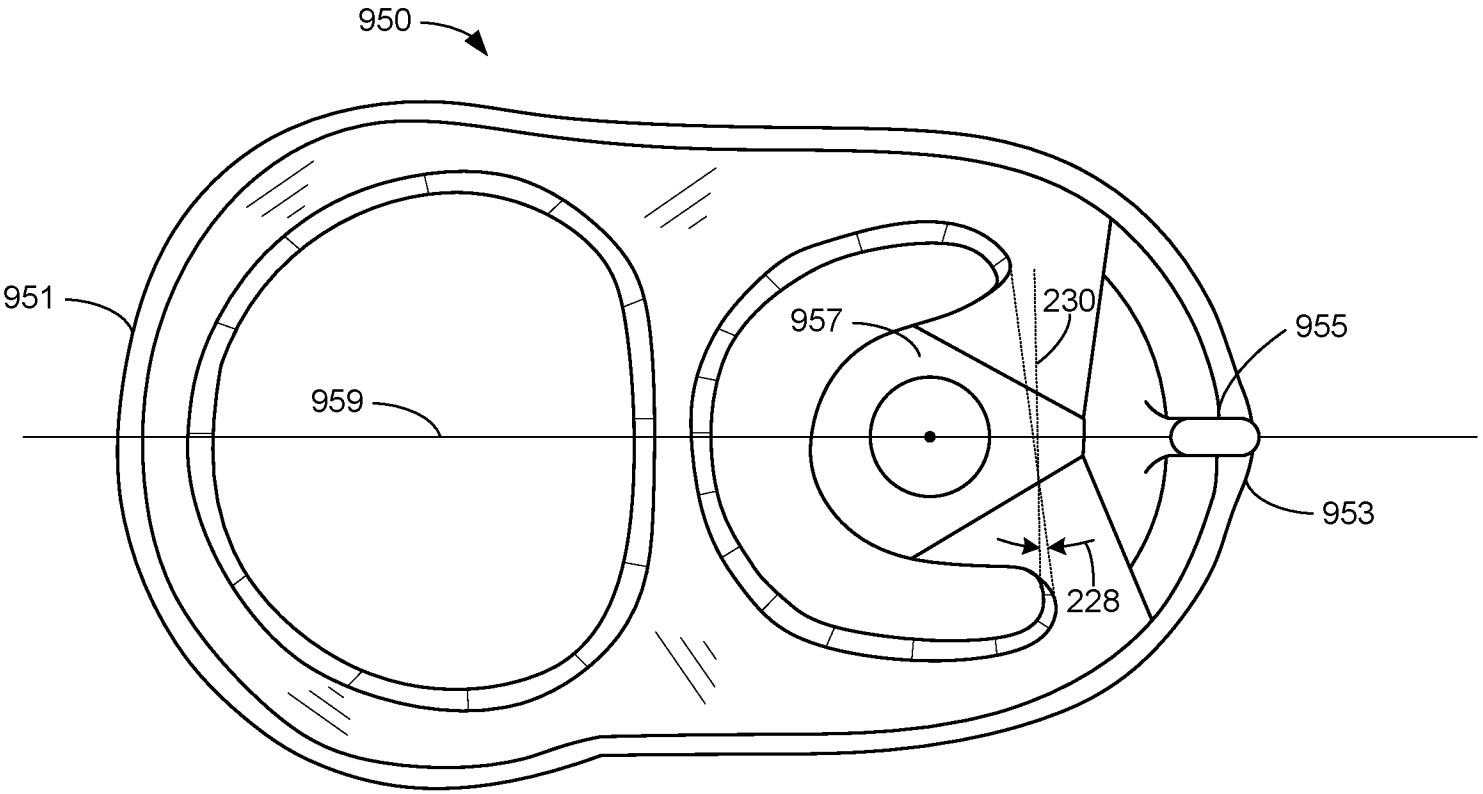
FIG. 9A is another example tab that may constructed with the example die assembly of FIG. 9.

The die assembly 900 of the illustrated example is not limited to the forming the tab 104 disclosed herein. On the contrary, the die assembly 900 of the illustrated example may be employed to form any type of tab with a pre-bend to compensate for springback. For example, FIG. 9A illustrates another example tab 950 disclosed herein that may be formed with the die assembly 900 disclosed herein. The tab 950 of the illustrated example includes a lift end 951, a nose 953 and a central webbing 955. The nose 953 of the illustrated example includes a cleat 955 that has a longitudinal axis that is aligned with a central axis 959 of the tab 950. The cleat 955 of the illustrated example is formed by the die assembly 900, which provides a downward angle to the tab 950 to enable the tab 950 to accommodate or compensate for springback and/or structural changes to a center panel of a can end. The tab 950 of the illustrated example includes the hinge line 222 having the angle 228 relative to the reference line 230. However, in some examples, the hinge line 222 of the illustrated example may be perpendicular relative to the central axis 959.

Figure 10:
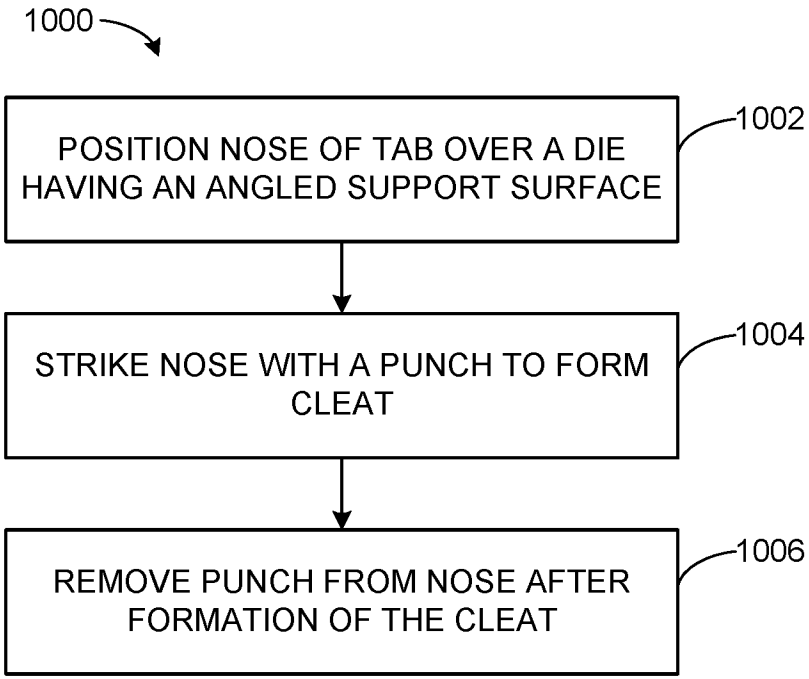
FIG. 10 is a flowchart illustrating a method of forming one or more cleats on an example tab disclosed herein.

FIG. 10 is a flowchart of an example method 1000 to manufacture a tab having one or more cleats disclosed herein. While an example manner of assembling the example tab 104 has been illustrated in FIG. 10, one or more of the steps and/or processes illustrated in FIG. 10 may be combined, divided, re-arranged, omitted, eliminated and/or implemented in any other way. Further still, the example method 1000 of FIG. 10 may include one or more processes and/or steps in addition to, or instead of, those illustrated in FIG. 10, and/or may include more than one of any or all of the illustrated processes and/or steps. Further, although the example method is described with reference to the flowchart illustrated in FIG. 10, many other methods of assembling the tab 104 may alternatively be used.

To begin the example process of FIG. 10, the nose 204 of the tab 104 is positioned over the die 902 having the angled support surface 906 relative to normal 910 prior to formation of the cleats 128 (block 1002). During formation of the cleats 128, the punch 904 strikes the upper surface 318 of the tab 104 while the die 902 supports the nose 204 of the tab 104 (block 1004). For example, the punch 904 is to cause the nose 204 of the tab 104 to engage the support surface 906 of the die 902 when the punch 904 strikes the upper surface 318 of the nose 204. The punch 904 and the angled support surface 906 of the die 902 cause a body 903 of the tab 104 to bend or flex (e.g., elastically flex) a distance beyond normal 910 defined by an angle 908 of the angled support surface 906 of the die 902. After formation of the cleats 128, the punch 904 is removed from engagement with the upper surface 318 of the tab 104 (block 1006). Springback causes the tab 104 to return to a position relative to normal 910 such that when the tab 104 is staked to the can end 100, a bottom surface 502 of the cleats 128 will be a distance 504 immediately adjacent the outer surface 134 of the pour panel 120 (e.g., within 1 to 2 millimeters).

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A tab for use with a can end, the tab comprising:

a lift end and a nose opposite the lift end, the nose to at least partially extend over a pour panel of the can end;

a central webbing interposed between the lift end and the nose, the central webbing defining a hinge line about which the tab is to pivot away from a center panel of the can end when the tab is coupled to the can end;

a first cleat formed on the nose, the first cleat being offset relative to a first side of a center axis of the tab; and a second cleat formed on the nose and spaced from the first cleat, the second cleat being offset relative to a second side of the center axis opposite the first side.

2. The can end of claim 1, wherein a first longitudinal axis of the first cleat intersects the center axis at a first angle.

3. The tab of claim 2, wherein the hinge line is at a non-perpendicular angle relative to the center axis of the tab to form a pivot angle relative to normal.

4. The tab of claim 3, wherein the first angle is substantially equal to the pivot angle.

5. The tab of claim 3, wherein the first angle is different than the pivot angle.

6. The tab of claim 3, wherein the first angle of the first cleat is approximately within plus or minus 4 degrees of the pivot angle.

7. The tab of claim 3, wherein the first angle of the first cleat is approximately within plus or minus 2 degrees of the pivot angle.

8. The tab of claim 3, wherein the second cleat is offset relative to the first side of the center axis of the tab such that a second longitudinal axis of the second cleat intersects the center axis at a second angle.

9. The tab of claim 8, wherein the second angle is substantially equal to the first angle.

10. The tab of claim 8, wherein the second angle is approximately within plus or minus 4 degrees of the pivot angle.

11. The can end of claim 1, wherein a bottom surface of the first cleat is substantially flat or planar to provide an increased frictional force to restrict the tab from sliding relative to an outer surface of the pour panel and toward the central webbing when the lift end is lifted away from the center panel.

12. The can end of claim 1, wherein the first cleat and the second cleat increase a longitudinal length of the tab in a direction along the center axis of the tab between the first cleat and the second cleat.

13. A can end comprising:

a center panel having a pour panel defined by a score;

a tab to pivot relative to the center panel to apply an opening force to rupture the score and displace the pour panel relative to the center panel to provide a pour opening, the tab including:

a lift end and a nose spaced from the lift end;

a first cleat having a first bottom area defined by first and second opposing walls formed on the nose, the first cleat being offset relative to a center axis of the tab, the first cleat to concentrate the opening force in a first direction that is non-parallel relative to the center axis when the tab is lifted relative to the center panel of the can end between an initial position and a first angular position; and a second cleat having a second bottom area defined by third and fourth opposing walls formed on the nose, the second cleat being offset relative to the center axis of the tab, the second cleat to concentrate the opening force in a second direction that is non-parallel to the center axis when the tab is lifted relative to the center panel between the first angular position and a second angular position greater than the first angular position, the first direction being different than the second direction.

14. The tab of claim 13, wherein the first cleat is to concentrate the opening force to a first side of the center axis when the tab is lifted between the initial position and the first angular position.

15. The tab of claim 14, wherein the first angular position is approximately between 40 degrees and 60 degrees relative to the center panel.

16. The tab of claim 14, wherein the second cleat is to concentrate the opening force to a second side of the center axis when the tab is lifted between the first angular position and the second angular position, the first side being opposite the second side.

17. The tab of claim 16, wherein the second angular position is approximately between 60 degrees and 80 degrees relative to the center panel.

18. The tab of claim 13, wherein the first cleat is positioned on a first side of the center axis at an angle of approximately between 4 and 12 degrees, and wherein the second cleat is positioned on a second side of the center axis at an angle of approximately between 4 and 12 degrees.

19. A can end comprising:

a center panel having a tear panel defined by a score;

a tab pivotally coupled to the center panel via a rivet, the tab to pivot relative to the center panel to apply an opening force to rupture the score and displace the tear panel relative to the center panel to provide a pour opening, the tab including:

a lift end and a nose spaced from the lift end;

a first cleat formed on the nose, the first cleat to concentrate the opening force in a first direction when the tab is lifted relative to the center panel of the can end between an initial position and a first angular position; and a second cleat formed on the nose, the second cleat to concentrate the opening force in a second direction when the tab is lifted relative to the center panel of the can end between the first angular position and a second angular position greater than the first angular position.

20. The can end of claim 19, wherein the first cleat is aligned with a center axis of the tab.

21. The can end of claim 19, wherein the first cleat is offset relative to a center axis by a first angle.

22. The can end of claim 21, wherein the second cleat is offset relative to the center axis by a second angle, the second cleat being spaced from the first cleat.

23. The can end of claim 19, wherein the tear panel includes a first segment positioned on a first side of a center line of the tab and a second segment on a second side of the center line of the tab opposite the first side, the first cleat to impart a force to the first segment and the second cleat to impart a force to the second segment.

* * * * *